United States Patent [19]

Batson

[11] 4,403,730

[45] Sep. 13, 1983

[54] MAILBOX STAND

[76] Inventor: Bruce L. Batson, Stratton Lake Rd., Ashland City, Tenn. 37015

[21] Appl. No.: 270,889

[22] Filed: Jun. 5, 1981

[51] Int. Cl.[3] ..... B65D 91/00

[52] U.S. Cl. ..... 232/39

[58] Field of Search ..... 248/146; 232/10, 39

[56] References Cited

U.S. PATENT DOCUMENTS 2,172,742 9/1939 Matthai ..... 232/39

2,605,073 7/1952 Buck ..... 232/390 X

*Primary Examiner*—Robert Peshock

*Attorney, Agent, or Firm*—Luedeka & Neely

[57] ABSTRACT

The specification discloses an adjustable mailbox stand (10) that includes a standard studded fence post (12) with a support bracket (14) mounted thereon. The bracket (14) includes a sleeve (30) dimensioned to fit over and slide along the fence post 12. A truss arm (36) extends upwardly and outwardly from the sleeve (30), and a plate (38) is mounted on the upper end of the truss arm for securing a standard sized mailbox thereto. An indent (32) is formed in the sleeve (30) adjacent to studs (22) that extend from and along the fence post (12). A set screw (34) is disposed on the opposite side of the sleeve (30) from the indent (32) so that when the set screw (34) is tightened, the indent (32) is forced between the studs (22) to lock the sleeve (30) in a desired position.

6 Claims, 8 Drawing Figures

MAILBOX STAND

FIELD OF INVENTION

The present invention relates to mailbox stands, and particularly relates to a mailbox stand using a conventional studded steel fence post with a bracket mounted on and interacting with the fence post.

BACKGROUND OF INVENTION

The present invention provides a simple, inexpensive, adjustable stand for rural type mailboxes. In rural areas, mailboxes must be of a certain standard size and are positioned along side the road mounted at a height dictated by the postal authorities. Typically, such mailboxes are mounted on wooden posts and it is difficult to properly position the mailbox sufficient near the road and at the correct height.

Adjustable mailboxes are known in the prior art, such as disclosed in U.S. Pat. Nos. 4,213,560; 4,172,579; 4,113,213; 3,999,702; 3,833,168 and 3,465,994. However, these known devices are generally expensive to manufacture and typically rely on frictional clamp devices or mechanisms to provide adjustability. Such adjustment mechanisms are particularly subject to slippage during use which may be caused by road vibrations, vibrations and irregular movement due to wind, rain and weather, or the repetitive rocking action imparted on the mailbox by repetitively opening and closing the mailbox door. Also, slippage in such known devices may result from improper installation of the mailbox initially. For example, in U.S. Pat. No. 4,213,560, the mailbox is secured to a mailbox post 12 by a single set screw 32. If this set screw is improperly tightened initially, the mailbox is likely to slip down the post.

Thus, a need exists for a simple inexpensive mailbox stand that provides a locking type adjustment mechanism to avoid slippage problems and to facilitate proper installation of the mailbox.

SUMMARY OF THE INVENTION

The foregoing and other problems associated with the adjustable mailbox stands are solved by the present invention in which a mailbox stand for supporting a standard rural delivery mailbox includes a steel fence post for being secured in the ground adjacent the road. A plurality of studs project from one side of and along the length of the fence post, and a sleeve fits over the fence post and is dimensional to slide along the length thereof. Fastening structure is provided on the sleeve for selectively engaging and interacting with the studs on the fence post to fasten the sleeve to the fence post at a selected position. A truss arm extends outwardly and upwardly from the sleeve and includes an outer end disposed in a position spaced apart from the fence post. Structure is provided on the outer end of the fence post for mounting the mailbox thereon.

In the preferred embodiment, the steel fence post has a T-shaped horizontal cross section with a base member and a cross member attached at its midsection to one end of the base member, and the studs of the fence post are positioned on the outer surface of the cross member projecting in a direction away from the base member. The fastening structure includes an indent formed on the lower edge of the sleeve at a position that is adjacent to the studs on the fence post. A threaded aperture is formed in the sleeve on the opposite side of the sleeve from the indent, and the aperture is positioned laterally on one side of the sleeve so that the aperture is spaced laterally with respect to the base member of the fence post. A set screw is disposed in the threaded aperture and extends along and beside the base member to engage the cross member of the fence post. The set screw is operable when tightened to force the fence post to one lateral side of the sleeve into a binding position and to urge the indent toward the fence post into a position above and engaging a selected one of the studs on the fence post.

In accordance with another aspect of the present invention, a plate extends downwardly from the outer of the truss arm and is configured with a plurality of apertures formed therein for attachment to a conventional newspaper receptacle.

In accordance with another embodiment of the invention, the steel fence post has a U-shaped horizontal cross section with the studs extending outwardly from the midsection of the U-shaped steel fence post and along the length thereof. The studs are formed as lipped flanges that extend outwardly from the fence post and then upwardly in a parallel relationship with the fence post. A sleeve fits over the fence post and is dimensioned for sliding along the length thereof. The lower portion of the sleeve is dimensioned to fit between the lipped flanges and the steel fence posts so that the sleeve rests upon the lipped flanges and downward slippage of the sleeve is prevented thereby. A threaded aperture is formed on the opposite side of the sleeve from the lipped flanges of the steel fence post, and a set screw is threadedly disposed in the threaded aperture. The set screw extends through the U-shaped cross section of the fence post and engages the mid-section thereof to hold the sleeve in a desired position on the fence post.

BRIEF DESCRIPTION OF THE DRAWINGS

The present invention may best be understood by reference to the embodiment disclosed in the Detailed Description when considered in conjunction with the accompanying Drawings in which.

DETAILED DESCRIPTION

Figure 1:
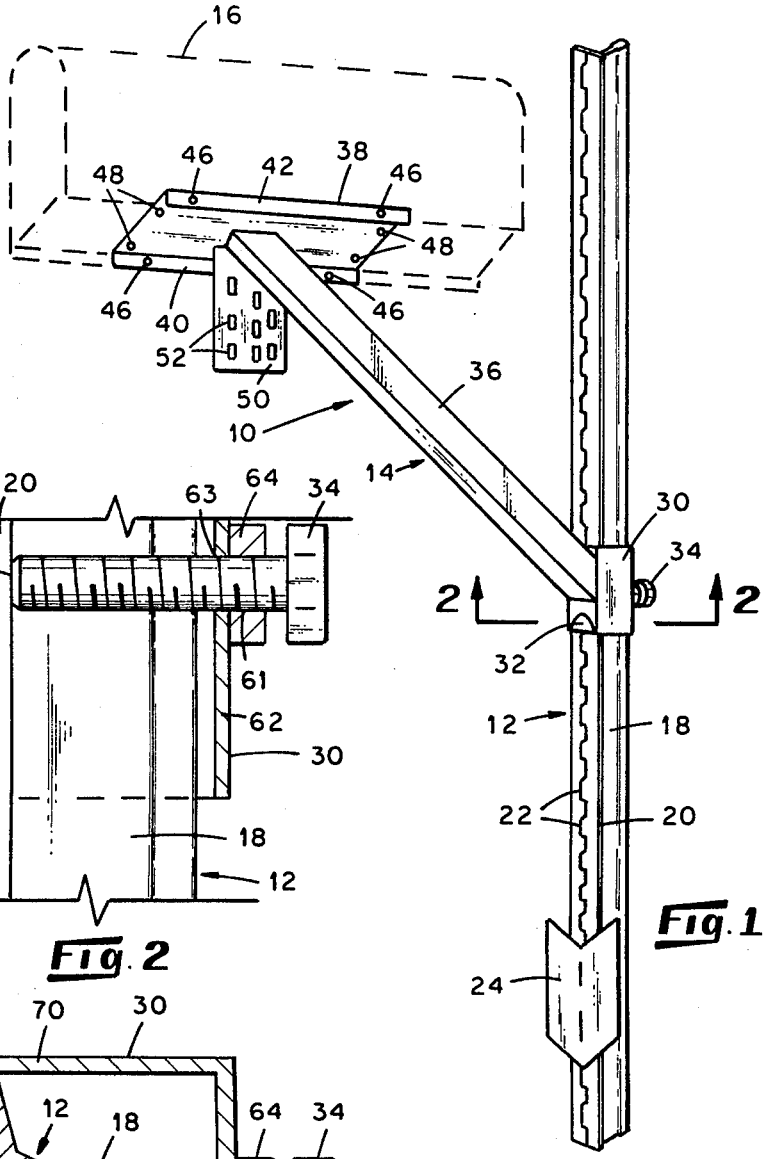
FIG. 1 is a perspective view of the mailbox stand of the present invention.

Referring now to the Drawings in which like reference characters designate like or corresponding parts throughout the several views, there is shown in FIG. 1 a mailbox stand 10 embodying the present invention. The mailbox stand 10 includes a standard steel fence post 12 and a mailbox support bracket 14 for supporting a mailbox 16 on the fence post.

The fence post 12 has a T-shaped cross section so that it includes a base member 18 and a cross member 20 attached at its midsection to the base member 18. A plurality of studs 22 project from the exterior surface of the cross member 20 in a direction away from the base member 18. These projections are generally disposed on the midsection of the cross member 20 and extend in a longitudinal row along the length of the fence post 12. An anchor plate 24 is attached to the lower end of the fence post 12 so that when the post 12 is driven into the ground, the anchor plate 24 will resist lateral and pivotal movement of the fence post 12.

The support bracket 14 includes a sleeve 30 dimensioned to fit over the steel fence post 12. An indent 32 is formed in the lower edge of the sleeve 30 in a position adjacent to the studs 22. A set screw 34 is provided on the opposite side of the sleeve 30 from the indent 32, and when the set screw 34 is tightened, the sleeve is urged in the direction of the set screw. Thus, the indent 32 is urged toward the fence post 12 to interact with studs 22 so that the sleeve 30 is locked in the desired position on the fence post 12. In the locked position, the lower edge of the indent 32 is disposed above and engaging one of the studs 22 so that the sleeve 30 cannot slide down the fence post 12.

To adjust the position of the sleeve 30, and thus the position of the support bracket 14, the set screw 34 is loosened and the indent 32 is pulled away from the fence post 12. In this position, the sleeve 30 is free to slide up or down the fence post.

A truss arm 36 is welded to the sleeve 30 and extends upwardly therefrom at an angle of approximately 45°. At the upper end of the truss arm 36, a plate 38 is welded thereto and is configured to receive and mount a plurality of standard size mailboxes.

The plate 38 includes a pair of flanges 40 and 42 extending downwardly from the lateral edges thereof. A plurality of apertures 46 are formed in the flanges 40 and 42 and a plurality of apertures 48 are formed in the plate 38 for receiving bolts, screws and the like for use in mounting a mailbox 16 thereon.

A vertical plate 50 extends downwardly from one side of the upper end of the truss arm 36. The vertical plate 50 includes a plurality of apertures 52 that are shaped as rectangular slots. The apertures 52 are dimensioned so that a conventional newspaper receptacle is easily mounted thereon.

Figure 2:
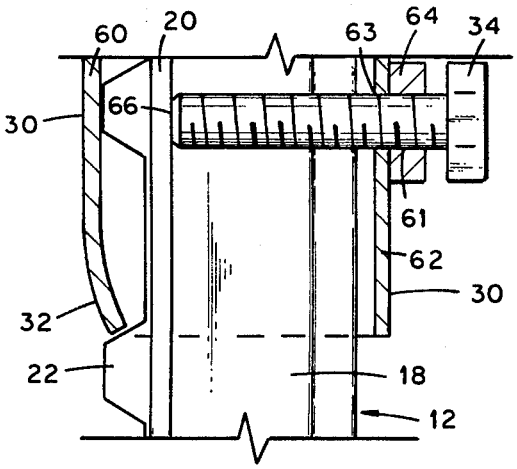
FIG. 2 is a somewhat diagrammatical, vertical, sectional view of the sleeve and the fence post of the present invention.

Referring now to FIG. 2, there is shown a vertical cross sectional view of the sleeve 30 and fence post 12 taken through the center of the set screw 34. In this view, it may be seen that the indent 32 is formed in the front side 60 of the sleeve 30. The indent 32 is configured to fit between the studs 22 so that when the set screw 34 is tightened, the indent 32 fits between the studs 22 and engages the upper edge of one stud 22. In this manner, the sleeve 30 is locked in position on the fence post 12.

The set screw 34 is mounted in a threaded aperture 61 on the opposite side 62 of the sleeve 30 from the indent 32. The threaded aperture 61 is formed by drilling a bore 63 in side 62 and welding a threaded nut 64 to the outer surface of side 62 in alignment with the bore 63. The set screw 34 extends through the threaded nut 64, along and adjacent to the base member 18 of the fence post 12, and engages the cross member 20 of the fence post 12 to urge side 62 of the sleeve 30 away from the fence post and, thus, urging side 60 of the sleeve 30 toward the fence post. In this manner, the indent 32 is forced to proper position above the stud 22.

Figure 3:
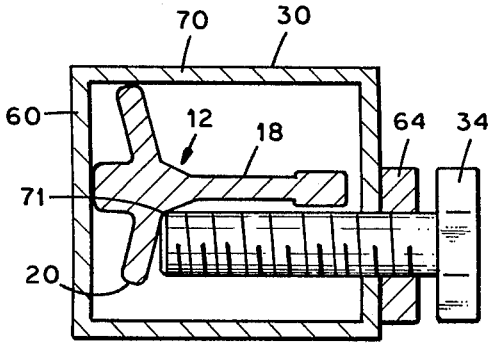
FIG. 3 is a somewhat diagrammatical horizontal cross section of the sleeve and fence post of the present invention taken through the center of a set screw that fastens the sleeve to the fence post.

Referring now to FIG. 3, there is shown a horizontal cross section of the sleeve 30 and the fence post 12 taken through the center of the set screw 34. In this view, it may be seen that the end 66 of the set screw 34 engages the cross member 20 and forces the fence post 12 against sides 60 and 70 of the sleeve 30. By engaging the cross member 20 in a off-center position, the fence post 12 is forced to one side of the sleeve 30 and into a binding position. The end 66 of set screw 34 engages the cross member 20 at a curved surface 71 extending between the base member 18 and the cross member 20. Because of the inclination of surface 71 at the point of contact with end 66, the force of the set screw 34 wages side 70 of the sleeve 30 toward the fence post 12.

Also, the set screw 34 will prevent rotation of the fence post 12 within the sleeve 30. With reference to FIG. 3, clockwise rotation of the fence post 12 would be prevented by the engagement of the base member 18 against the set screw 34, and counterclockwise rotation of the fence post would be prevented by the engagement of cross member 20 with end 66 of the set screw 34.

Figure 4:
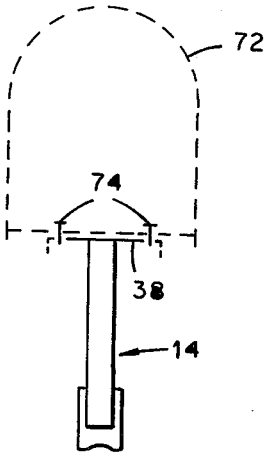
FIG. 4 is a front diagrammatical view of the mailbox stand showing a large rural mailbox mounted thereon.

FIG. 4 diagrammatically shows the mounting of a large rural mailbox 72 on plate 38 of the support bracket 14. The mailbox 72 is secured to the plate 38 by a plurality of vertical bolts 74 extending through plate 38 and the bottom surface of the mailbox 72.

Figure 5:
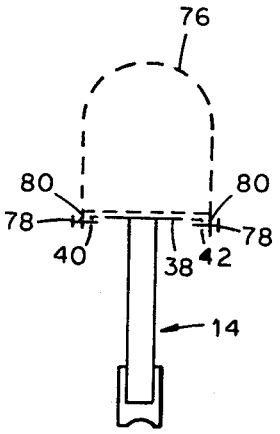
FIG. 5 is a diagrammatical view of the mailbox stand showing a relatively small mailbox mounted thereon.

FIG. 5 discloses a small standard size mailbox mounted on the plate 38 of the support bracket 14. A plurality of bolts 78 are mounted horizontally through flanges 80 that extend downwardly from the mailbox 76 and through flanges 40 and 42 that extend downwardly from plate 38.

Figure 6:
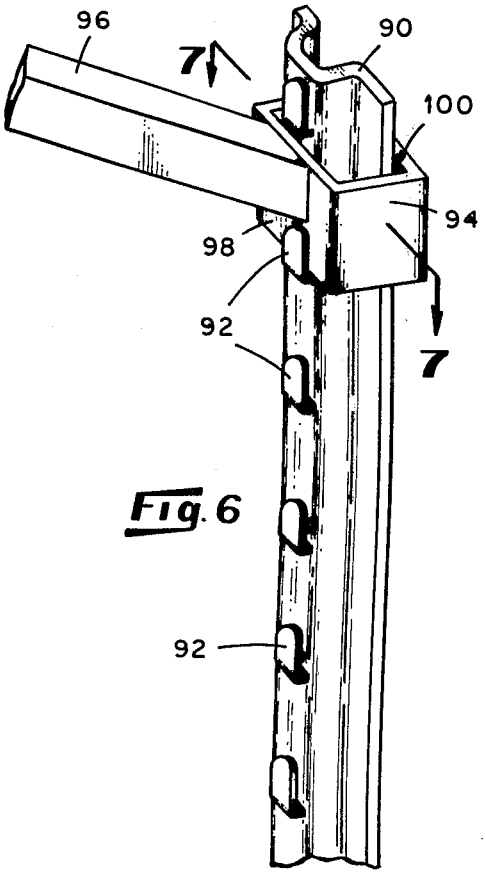
FIG. 6 is a perspective view of another sleeve and fence post of another embodiment of the present invention.

Referring now to FIG. 6, there is shown a U-shaped steel fence post 90 having a plurality of studs in the form of lipped flanges 92 extending outwardly from the midsection of the fence post 90 and then extending upwardly in a parallel relationship with the fence post 90. A sleeve 94 is positioned fitting over the fence post 90 with a truss arm 96 extending upwardly and outwardly from the sleeve 94. The fence post 90 and sleeve 94 are alternate embodiments of and may be substituted for the fence post 12 and sleeve 30 shown in FIGS. 1, 2 and 3.

The front lower edge of the sleeve 94 is dimensioned to fit between the lipped flange 92 and the fence post 90. In this manner, the sleeve 94 may be inserted into the lip flange 92 to prevent the sleeve from slipping downward along the fence post 90. The sleeve 94 is dimensioned having sufficient width and depth so that the sleeve may be moved upwardly and downwardly along the fence post 90. Thus, as shown in FIG. 6, there is a space 100 formed between the fence post 90 and the sleeve 94.

Figure 7:
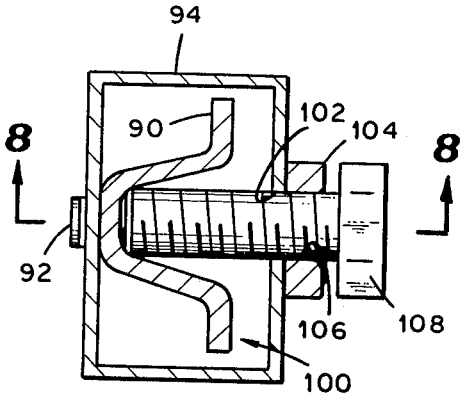
FIG. 7 is a top cross-sectional view of the sleeve and fence post shown in FIG. 6 taken through the section line 7—7.

A top cross sectional view of the fence post 90 and sleeve 94 taken through section line 7—7 is shown in FIG. 7. In this view, it may be seen that an aperture 102 is formed on the rear side of the sleeve 90 opposite from the lipped flanges 92 formed on the fence post 90. A threaded nut 104 is mounted adjacent the aperture and includes a threaded aperture 106 aligned with aperture 102. Thus, nut 104 forms a threaded aperture 106 on the rear side of the sleeve 94. A set screw 108 is threadedly mounted in the threaded aperture 106 and extends through the sleeve 94, through the U-shaped cross-section of the fence post 90 and engages the rear side of the midsection of the fence post 90. In this matter, the sleeve 94 is clamped to the fence post 90.

Figure 8:
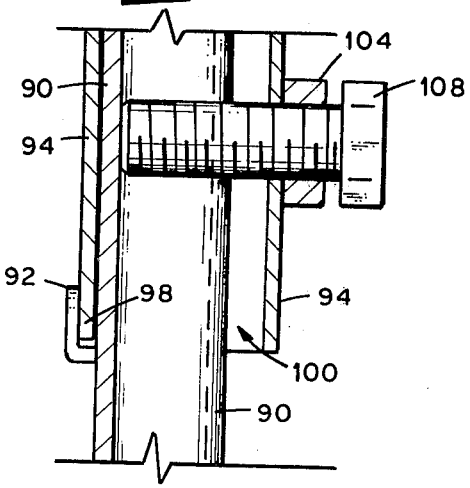
FIG. 8 is another cross-sectional view of the sleeve and fence post of FIG. 6 taken through section line 8—8 shown in FIG. 7.

Referring now to FIG. 8, there is shown a side cross-sectional view of the fence post 90 and the sleeve 94 taken through sectional line 8—8 shown in FIG. 7. In this view, it is clearly shown that the front lower side 98 of the sleeve 94 rests within and on the lipped flange 92. The set screw 108 engages the midsection of the fence post 90 and forces the front side 98 of the fence post 90 towards the fence post. Consequently, a space 100 is formed between the fence post and the rear side of the sleeve 94. To adjust the position of the sleeve 94, the set screw 108 is loosened and the sleeve 94 is moved upwardly and then laterally to move the front side 98 of the sleeve 94 away from the fence post 90. In this position, the sleeve 94 may slide up and down the fence post, and there is sufficient space between the sleeve 94 and the fence post 90 so the sleeve 94 clears the lipped flanges 92.

Although a particular embodiment of the invention has been described in the foregoing Detailed Description, it will be appreciated that the invention is capable of numerous rearrangements, modifications and substitutions of parts without departing from the spirit of the invention.

I claim:

1. A mailbox stand for supporting a standard rural delivery mailbox adjacent to a road, comprising:

a steel fence post for being secured in the ground adjacent the road and having a T-shaped cross section formed by a base member and a cross member attached at its midsection to one end of said base member;

a plurality of studs disposed along the length of said fence post projecting from the outer surface of said cross member in a direction away from said base member;

a sleeve dimensioned for fitting over and sliding along the length of said fence post;

an indent in said sleeve for engaging and interacting with said studs on said fence post to fasten said sleeve to said fence post at a selected position;

a threaded aperture formed in said sleeve on the opposite side of said sleeve from said indent and being diposed in a laterally offset position on one side of said sleeve so that said aperture is spaced laterally with respect to said base member of said fence post; and a set screw disposed in said threaded aperture and extending along and beside said base member to engage said cross member, said set screw being operable when tightened to force said fence post to one side of the sleeve into a binding position and to urge said indent toward said fence post into a position above and engaging a selected one of said studs of said fence post;

a truss arm extending from said sleeve and having an outer end disposed in a position spaced apart from said fence post; and means for mounting the mailbox on the outer end of said truss arm.

2. The mailbox stand of claim 1 wherein said indent is formed on the lower edge of said sleeve at a position adjacent to said studs of said fence post, said indent being dimensioned to fit between any two of said studs; and said truss arm being attached to said sleeve at a position above said indent so that the weight applied by said truss arm to said sleeve provides a torque that urges said indent toward said fence post, whereby the weight applied by said truss arm forces said indent into engagement with one of said studs to prevent downward sliding motion of said sleeve on said fence post.

3. The mailbox stand of claim 1 wherein means for mounting comprise a plate fastened to the outer end of said truss arm and being configured for attachment to the underside of a conventional standard rural delivery mailbox.

4. The mailbox stand of claim 1 further comprising a plate extending downwardly from the outer end of said truss arm and being configured with a plurality of apertures formed therein for attachment to a conventional newspaper receptacle.

5. A mailbox stand for supporting a standard rural delivery mailbox adjacent to a road, comprising:

a steel fence post for being secured in the ground adjacent the road and having a U-shaped horizontal cross-section and having a midsection;

a plurality of studs in the form of lipped flanges extending outwardly from the midsection of the steel fence post and then upwardly in a parallel relationship with the fence post;

a sleeve dimensioned for fitting over and sliding along the length of said fence post;

a lower front edge formed on the sleeve and being dimensioned to fit between the lipped flanges and the fence post so that said sleeve rests on the lipped flanges to prevent downward slippage of said sleeve;

clamping means for clamping and securing said sleeve against said fence post with the lower front edge of said sleeve disposed between said lipped flanges and said fence post;

a truss arm extending from said sleeve and having an outer end disposed in a position spaced apart from said fence post; and means for mounting the mailbox on the outer end of said truss arm.

6. The mailbox stand of claim 5 wherein said clamping means comprises a threaded aperture formed in said sleeve on a side thereof opposite from the lipped flanges on said fence post; and a set screw threadedly mounted in said aperture for extending through the U-shaped cross-section of said fence post and engaging the midsection of said U-shaped fence post to clamp said sleeve to said fence post.

* * * * *